US006770118B2

(12) United States Patent
Stolyarevsky

(10) Patent No.: US 6,770,118 B2
(45) Date of Patent: Aug. 3, 2004

(54) GAS STORAGE CAPSULE AND METHOD FOR FILLING SAID CAPSULE

(75) Inventor: Anatoly Yakovlevich Stolyarevsky, Moscow (RU)

(73) Assignee: World Laboratory Complex Technology and Energotechnological System Center, Moscow (RU)

( * ) Notice: Subject to any disclaimer, the term of this patent is extended or adjusted under 35 U.S.C. 154(b) by 0 days.

(21) Appl. No.: 10/064,924

(22) Filed: Aug. 29, 2002

(65) Prior Publication Data

US 2003/0136261 A1 Jul. 24, 2003

Related U.S. Application Data

(63) Continuation of application No. PCT/RU01/00083, filed on Feb. 26, 2001.

(30) Foreign Application Priority Data

Feb. 29, 2000 (RU) ..... 2000104684

(51) Int. Cl.[7] ..... B65D 83/14

(52) U.S. Cl. ..... 95/90; 96/147; 222/192; 206/0.7

(58) Field of Search ..... 96/108, 147, 151, 96/373; 95/90, 92; 55/417; 222/3, 192, 189.06, 189.09, 189.11, 399, 511; 206/0.7; 220/560.04–560.15; 62/45.1–54.3; 22/3, 192, 189.06, 189.09, 189.11, 399, 511

(56) References Cited

U.S. PATENT DOCUMENTS

| | | | | | |
|---|---|---|---|---|---|
| 3,122,284 | A | * | 2/1964 | Miles | 222/399 |
| 3,964,649 | A | | 6/1976 | Alexander | 222/399 |
| 4,049,158 | A | * | 9/1977 | Lo et al. | 222/95 |
| 4,182,688 | A | * | 1/1980 | Murtaugh | 252/372 |
| 4,600,123 | A | * | 7/1986 | Galbraith | 222/3 |
| 5,005,362 | A | * | 4/1991 | Weltmer et al. | 62/45.1 |
| 5,032,619 | A | * | 7/1991 | Frutin et al. | 521/55 |
| 5,234,140 | A | * | 8/1993 | Demarest et al. | 222/394 |
| 5,409,526 | A | * | 4/1995 | Zheng et al. | 96/132 |
| 6,132,492 | A | * | 10/2000 | Hultquist et al. | 95/45 |

FOREIGN PATENT DOCUMENTS

| | | |
|---|---|---|
| RU | 2063915 C1 | 7/1996 |
| RU | 2086489 C1 | 8/1997 |
| RU | 2105709 C1 | 2/1998 |

* cited by examiner

*Primary Examiner*—Frank M. Lawrence
(74) *Attorney, Agent, or Firm*—Houston Eliseeva LLP

(57) ABSTRACT

The capsule and method for its filling concern to engineering of storage of gases and may be used in medicine, in household chemistry, in fire engineering, in perfumery, as a source of gas for inflatables etc. The invention will allow to simplify and speed up processes of creation of superfluous pressure in aerosol and others inflatable products to raise safety of their operation. The capsule for storage of gas contains the gas proof body, inside which the sorbent material particles for gas sorbing are placed, and which is provided by the outlet sealed channel. According to the invention the body contains the sorbent free space, which volume is sufficient to place the preset amount of the gas to be sorbed in the solid phase, and is so made, that the gas to be sorbed can be brought into the body in the solid phase.

14 Claims, 3 Drawing Sheets

GAS STORAGE CAPSULE AND METHOD FOR FILLING SAID CAPSULE

This application is a continuation of international application no. PCT/RU01/00083, filed on Feb. 26, 2001.

BACKGROUND OF INVENTION

The invention relates to the packing technique field and can be used in the varnish and paint spray cans, perfume industry, fire fighting technique and in the everyday life for spraying household chemicals and drink aeration The known pressurized dispensing device consists of the body, dispensing valve, which is placed in the opening on the body side, a liquid to be dispensed, propellant, a propellant sorbed by a sorbent material, placed inside the body (International Application PCT/RU92/00129, filed: Jun. 26, 1992; Priority Date Jun. 29, 1991; International Publication Number WO 93/00277, Date: Jan. 7, 1993, International Classification 5 B 65 D 83/14).

The filling (charging) of such a pressurized dispensing container is accomplished by means of the charging valve for a sorbent material and propellant and by the dispensing valve, which permits the high degree and quality filling of the container with the liquid to be dispensed. With that the known device requires providing special equipment for filling (charging) the dispensing container. It requires providing automatic rotor systems for charging of such containers without allowing to reuse such pressurized dispensing containers for various dispensed substances and gas, because of the complexity of cleaning of the dispensing body and of preparing of the sorbent material.

There is also known a pressurized dispensing container, which includes the body, the dispensing valve, installed in the opening of the body wall, the liquid to be dispensed, propellant, capsule, which are placed inside the body, sorbent substance particles saturated with propellant gas and placed inside the capsule, and the filter element, which serves as a capsule body cover. The device is permeable for the propellant gas because of the openings in the gas impermeable material, which openings are impermeable to the sorbent particles (U.S. Pat. No. 3,964,649).

This device is relatively simple, since the pressurized dispensing container can be charged with the dispensing liquid and capsule through the opening (orifice) in the body wall before the installation of the dispensing valve.

There is also a known method for filling a dispensing container by placing a sorbent material into the capsule which is permeable for the propellant gas and impermeable for the particles, filling the sorbent material with the propellant gas, filling the container with the dispensing liquid, pumping the propellant gas and inserting the capsule into the dispensing container, and hermetically sealing the body of the dispensing container (U.S. Pat. No. 3,964,649).

This method can deteriorate the quality of the saturation of the sorbent material by propellant gas, because the materials with an absorption heat in the sorbent substance higher than that of the propellant can penetrate the sorbent substance.

There is also knows a capsule for gas storage, which capsule contains a gas impermeable body inside which the particles of a sorbent material saturated faith a gas are placed, and which is supplied with an outlet sealed channel (Patent RU 2086489 C1, B 65 D 83/14, Aug. 10, 1997). The known device has the means for locking the gas outlet and is positioned in a predetermined way with regard to a technical opening, which limits the ways in which the capsule can be used.

SUMMARY OF THE INVENTION

The technical result accomplished by an embodiment of the invention is to provide of a sorbent material saturated by a gas to a high degree and to increase the number of ways in which the capsule can be used (versatility).

To achieve the described technical result, a capsule for gas storage is provided with a gas impermeable body into which the particles of a sorbent material for gas sorption are placed. The gas impermeable body is provided with a sealed outlet channel. The body contains a sorbent-fee portion of sufficient volume to receive a predetermined amount of solidified gas which is placed inside the gas impermeable body in the solid phase.

The sealing of the outlet channel can be made as a valve having an elastic element, which opens the gas outlet and releases the gas from the capsule only when the pressure inside the capsule exceeds the pressure of the medium surrounding the capsule by a predetermined value.

The body can be made as a cylinder, which consists of two or more parts.

The valve can be placed on the joint of the body parts.

The body part, accomplished as a petal-shaped element can serve as an elastic element.

The outlet sealed channel can be accomplished as a molecular sieve, which lets through only the molecules of the gas to be sorbed.

To solve the above-identified problem and to achieve the desired technical result, the method of filling the capsule with a sorbent gas comprises placing the sorbent into the capsule comprising a gas impermeable body. The gas impermeable body has a sorbent-free portion and is capable of releasing the gas and retaining the sorbent material inside the gas impermeable body. In addition, the method comprises placing a predetermined amount of a solidified gas into the sorbent-free portion and sorbing the gas inside the gas impermeable body by the sorbent material.

A possible embodiment of the method is by solidified gas is placed into the capsule before the capsule is filled with the sorbent material.

Another possible embodiment of the method is where the capsule is formed as a cylinder comprising at least two portions.

The above-referenced task was successfully accomplished by practicing the above indicated charging (filling) methods, wherein the capsule was made of a gas impermeable material with a sealed output channel and by providing a sorbent-free portion of sufficient volume for placing of a predetermined amount of a solidified gas and by such a construction of the body that makes it possible to place the solidified gas into the body.

BRIEF DESCRIPTION OF DRAWINGS

The advantages and the detailed description of the present invention will be clear when considering the further best embodiments of the invention with reference to the accompanying diagrammatic drawings wherein.

DETAILED DESCRIPTION

Figure 1:
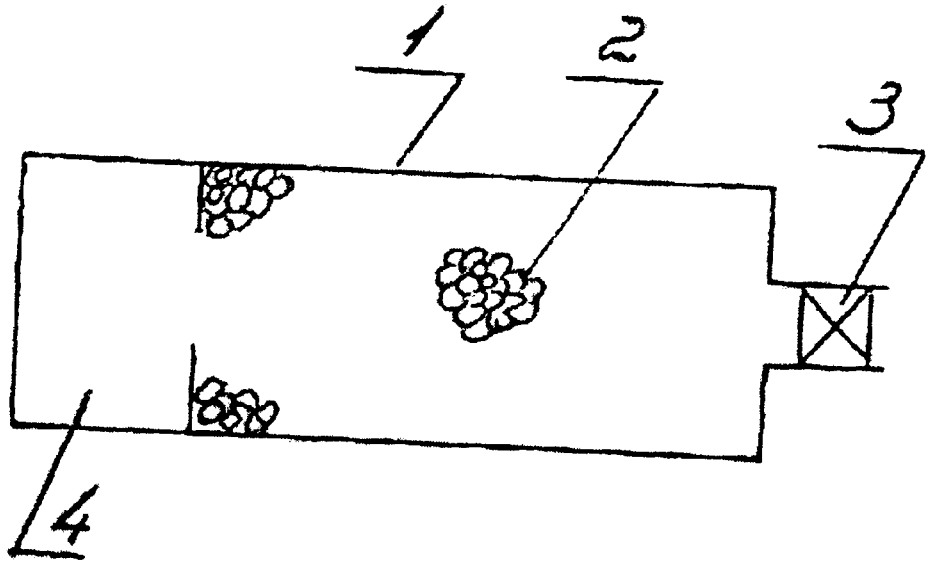
FIG.1 is a schematic representation of the capsule.

The capsule (FIG. 1) consists of a body 1, sorbent part 2 for gas sorbtion (gas isn't represented on the FIG. 1), outlet sealed channel 3 and sorbent free space 4, which includes the preset amount of gas to be sorbed both in the solid and in the liquid phase. The sealing of the outlet channel 3 can be made as a valve with an elastic element, which opens the gas outlet from the capsule 1 only when the pressure inside the capsule exceeds the environmental pressure on the preset value.

Figure 2:
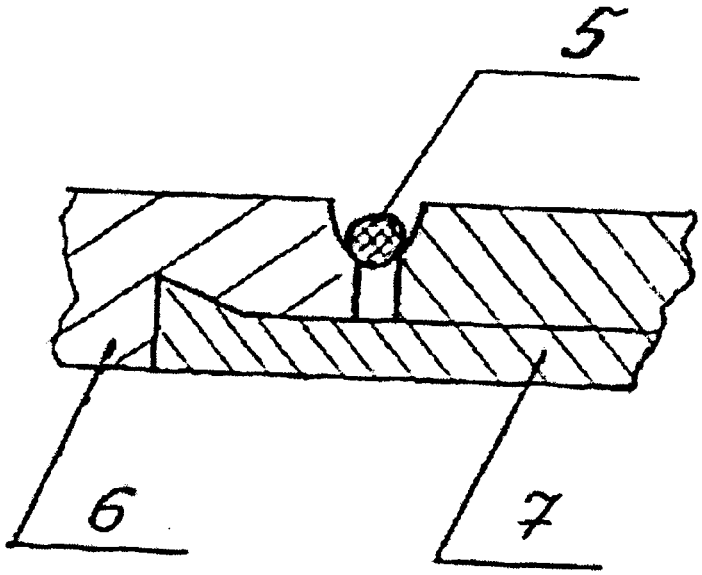
FIG. 2 is a cross-section of two portions and a joint with an elastic ring.

The elastic element 5 can be made as an elastic ring, as the FIG. 2 represents, which is installed at the outlet opening of the sealed outlet channel, which is formed by the fitting assembly between parts 7 and 6 of the body in this modification, and which opens the gas output from the capsule only when the pressure differential between the outer and inner surfaces of this ring exceeds the operating pressure differential, which causes the gas output through the output opening of channel 3. In this embodiment of the capsule the elasticity of the elastic ring 5, e.g. made of rubber, is fixed by the required deformation, producing the compressions, which exceed the tensions, caused by the operating pressure differential.

Figure 3A:
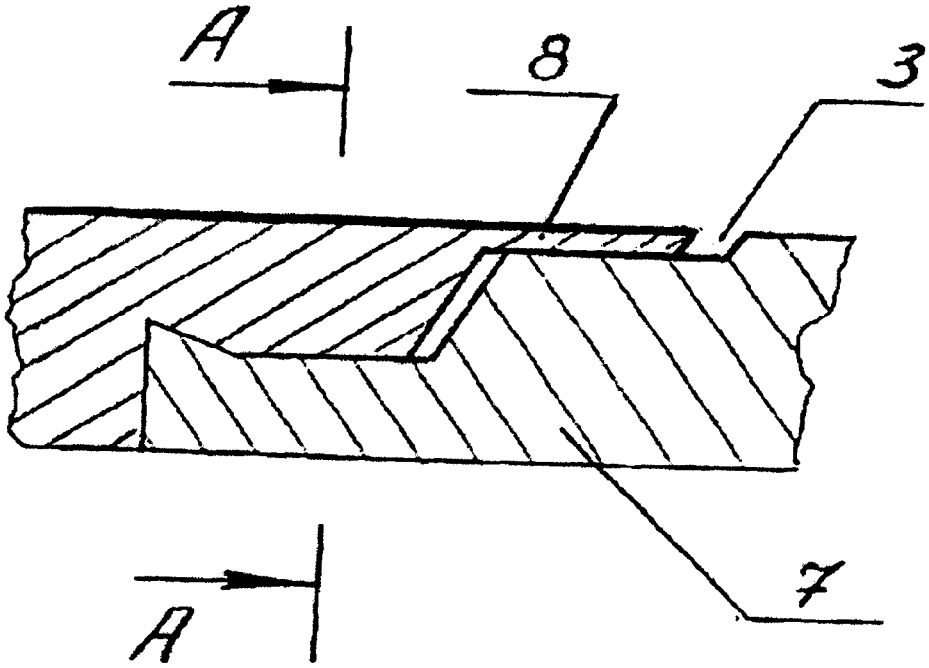
FIG. 3*a* is a cross-section of two portions with a petal-shaped elastic element formed by the body.
Figure 3B:
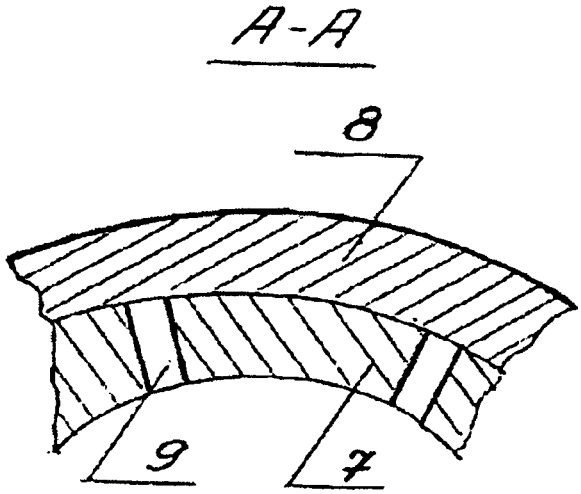
FIG. 3*b* is a cross-section of a petal shown in FIG. 3*a*.

Elastic element 5 can be made as a petal-shaped element 8, formed by the body part, as represented in the FIG. 3*a*, what is the simplest way for shape installing, which doesn't require the mutual positioning of the device surface and provides the close hermetic surfaces fitting of the body parts 6 and 7. To place one body part onto another, one of them, part 7, placed inside the fitting assembly, the slit 9 can be made in the holding shoulder; they facilitate the moving of the parts when processing the installation 6.

At the same time it is possible to make element 5 as a diaphragm, elastic cap, clamp, cotter and other known constructive elements, which provides the set compression value of the elastic element S and permits the gas outlet.

Figure 4:
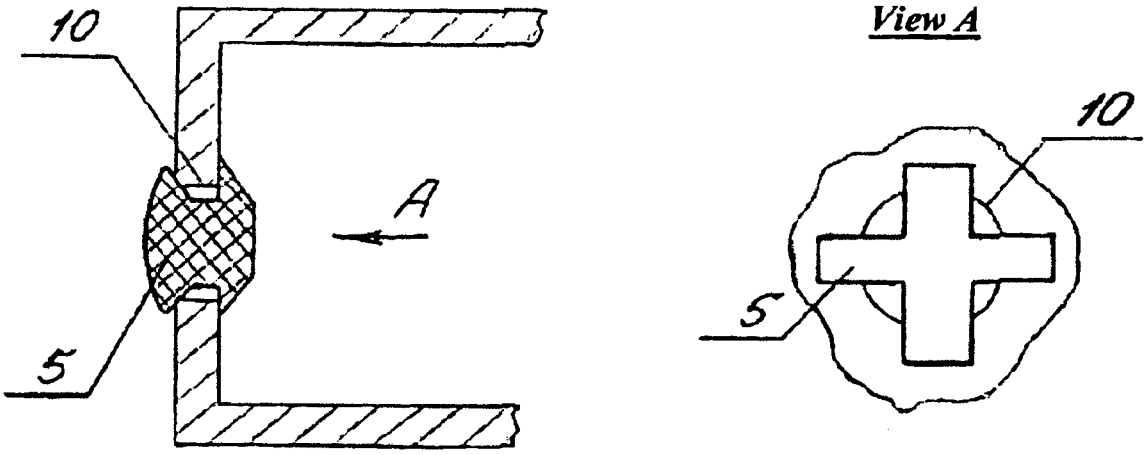
FIG. 4 is a representation of a capsule body part with an elastic element as a cap installed in the window of the body.

Inter alia the elastic element 5 can be designed as a cap, made e.g. of rubber and installed in window 10 of body 1, as represented on the FIG. 4. Providing such embodiment of elastic element 5, it can serve as a locking element, closing the window 10 after charging the capsule by sorbent particles 2 and gas to be sorbed in the solid phase.

Figure 5:
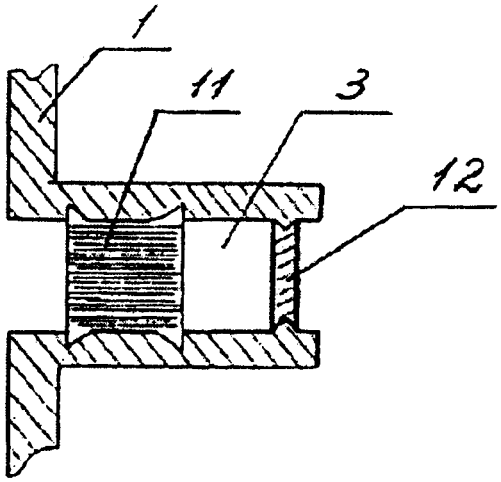
FIG. 5 is a cross-section of the part of the capsule body with an outlet channel sealed with molecular sieve and a barrier diaphragm.

The sealing of the outlet channel 3 can be made as a molecular sieve, as FIG. 1 and FIG. 5 represent, which is installed in the output opening of the sealed outlet channel 3, formed by this embodiment by the toe of body 1. Such element provides passing through the outlet channel only the molecules of the gas and stops the molecules of big diameter, e.g. organic ones, typical for the compositions, which practically include all possible fields of capsule using, which are made in accordance with the invention. To prevent the premature gas loss from the capsule, before its pressure increases to the preset value (when gas changes the solid or liquid phase to the gaseous, absorbing simultaneously gas in the sorbent material 2) the outlet channel can be provided with the barrier diaphragm 12. The gas outlet prevention can also be achieved providing the sealing arrangement of outlet channel 3, which is constructed, accordingly the FIG. 2, as elastic ring 5 or cap in the charging window 10, where the cap is placed after gas and sorbent material charging as additional means to prevent the passing into body 1, when pressure inside the capsule is lower than one of the environmental components, which either cause gas ejecting out of the sorbent material or influence the required quality of the medium, e.g. in the case of using the capsule as propellant gas source in spray cans for perfumery.

It is advisable to foresee the means, preventing the passing of the sorbent particles into channel 3 for gas passing, they can be porous elements, constructed as a part of body 1, e.g. as a grating at the inlet opening of channel 3, or as separate filter gas permeable elements of molecular sieve 11, which separate the space of sorbent particles from the outlet opening of channel 3.

Elastic element 5 can be made as an elastic sleeve, which envelops body 1 and closes the gas output from the capsule, if there is no pressure differential in and out of body 1.

The capsule works the following way.

During charging and short-time storage, e.g. at the pipe line or in the store, the inner overpressure of the capsule does not reach the preset value until the solid phase of the gas to be sorbed, vapouring under the influence of the environment, saturates the sorbent material to the preset level, wherein the lower sorption temperature assists, which is provided by the heat extraction for the phase transition of gas.

Herewith the closing of the outlet opening is provided by elastic element 5, as it is withheld by the compressions from the moving.

This way the hermetic encapsulating of the sealed outlet channel is provided. When placing the capsule into the operation medium, e.g. inside the container, where the overpressure is to be created, the phase gas transition results in the pressure increasing inside the capsule, and elastic element 5 designed as elastic petal of sealing 8 (FIG. 3*a*) releases and goes off the surface by the influence of the inner pressure in the capsule, connecting such a way the space of sorbent 2 with the capsule environment through outlet channel 3. Gas goes out of the capsule until the pressure out of the capsule grows to the value, which differs from the pressure value in the sorbent material space 2 by the preset value, wherefore the elastic sealing element 5 (FIGS. 1, 2 and 4), 8 (FIG. 3*a*) returns into its Initial position and closes the gas passing from the sorbent material space 2 through the output opening of the channel 3.

When pressure goes down in the operation environment, the aforementioned process is repeated.

There is necessary and sufficient regardless of the chosen real constructions for solving of the posed problem with the achievement of technical result to realize the above-described charge method, where the capsule charging is provided by the placing of the sorbent material into the capsule with sorbent particle retention property and possibility to outlet the gas out of the capsule and gas sorbing by the sorbent material in accordance with the invention form a free space inside the capsule, wherein the preset gas amount in solid phase is loaded.

To prevent the gas output of the capsule when charging it and to improve the sorbent saturation conditions, gas is loaded into the capsule before saturating the capsule by sorbent material.

To simplify and speed up the charging process of the capsule, it is cylinder-shaped, and consists of two or more parts.

Such charging process is advisable to be accomplished in the pipe-line mode, direct before placing the capsule into its the operating device, e.g. into the dispensing packing for maximum using of the gas, which is placed in the capsule. As the experiments demonstrated, the typical process time of the phase transition $CO_2$ makes dozens of seconds (when placing the $CO_2$ into the plastic cylinder in the dense hard condition), what exceeds by more than a degree the typical operation speeds of the industrial aerosol lines.

When considering this factor value by using of the capsule as a gas source in the pressure dispensing container for creating of the necessary gas pressure higher than 0.3 MPa for the complete liquid dispersion of the volume 250 ml providing that the gas outage out of the liquid and a capsule is chosen in the dispersing container as the minimal one (e.g. less than 25 ml). In this case the required gas amount, desorbed from the capsule into the dispersing container should be not less than 750 ml or about 1.5 g we using $CO_2$ as gas. When using water or compounds on its ground as the liquid to be sprayed to provide the necessary pressure inside the package both gas absorption by water, which will require the additional gas sorption 0.4 g for start pressure 0.75 MPa and charging with gas of the outage, which will require 0.4 g, must be taken in account. With allowance for the rest gas content in the sorbent material at the level of 0.5 g by the end pressure 0.3 MPa the total amount of gas, charging the capsule with the reserve for losses by charging will make nearly 3 g.

Herewith when using charcoal of the SKT type as sorbent material and providing the start pressure which equals 0.75 MPa in body 1 of the capsule by the temperature 22° C. the required amount of the sorbent material should be about 5 g, it will require the volume not less than 12 ml by the capsule charging density of the sorbent material 0.4 g/ml.

The necessary space volume for the solid phase placing of $CO_2$ by the preset amount 2.5 g will make nearly 2.5 ml (by sealing the solid phase to 1 g/ml). By vapouring of the above indicated amount of $CO_2$ inside the capsule, placed in the dispensing package, gas will be particularly sorbed in the sorbent material to the balance condition, determined by the pressure inside the capsule and by the balance temperature, what will make by the above indicated conditions about 1.8 g of the sorbed gas. The rest part of the vapoured solid phase of $CO_2$ will be sorbed by liquid, will charge the outage of the dispensing package and will be lost by the charging process. It is advisable to use $CO_2$, Ar, $N_2$, $O_2$, $N_2O$, as gas, and charcoal, zeolit, silica gel or their mixtures as sorbent material. Selection of different types of sorbent materials (e.g. charcoal+zeolit) permits to optimize the operation conditions of charging, storage and usage of the capsule.

As the example of the charging method, described in the present invention, can serve the following circuit, related to the above-described device.

The sorbent material, prepared to charging, i.e. degaserated, e.g. by the vacuum treatment and/or by heating, is placed into body 1 of the capsule, then the solid phase (so called "dry ice") shaped as a pill, bar or ball is input into the capsule, e.g. through window 10 in body 1, then elastic element 5, which joints hermetically to the inlet opening, and is made like a rubber cap in this embodiment, is put into window 10.

After that the capsule, completed and charged such a way in accordance with the invention is thrown into the package, filled with the liquid to be dispensed. The following step is the placing and rolling in of the dispensing valve.

Taking into account the high speed of the last operations (less than 1 s), the gas loss, going out of the capsule outside the packing comes to such little amounts, that it can be disregarded.

The invention can be used in medicine, fire technique for the creating of pressure in fire-extinguishing devices, in household chemistry, perfumery, as gas source for the articles, to be filled with gas and so on.

What is claimed is:

1. A gas storage capsule comprising:

a gas impermeable body with a sealed channel and a sorbent-free portion of the body;

particles of a sorbent material disposed inside the gas impermeable body; and the sorbent-free portion being of sufficient volume to receive a predetermined amount of a solidified gas, which solidified gas is inserted into the gas impermeable body, wherein the solidified gas becomes a propellant gas when released by the gas storage capsule.

2. The gas storage capsule of claim 1, wherein the sealed channel comprises a valve with an elastic element, the elastic element being capable of unsealing the channel when a pressure inside the gas impermeable body exceeds a pressure outside the gas impermeable body by a predetermined value.

3. The gas storage capsule of claim 1, wherein the gas impermeable body is cylindrical and comprises at least two portions joining each other at a joint.

4. The gas storage capsule of claim 2, wherein the gas impermeable body is cylindrical and comprises at least two portions joining each other at a joint.

5. The gas storage capsule of claim 3, further comprising a valve disposed in the joint.

6. The storage gas capsule of claim 4, further comprising a valve disposed in the joint.

7. The gas storage capsule as in claim 6, wherein the elastic element is a petal-shaped portion of the gas impermeable body.

8. The gas storage capsule of claim 1, wherein the sealed channel comprises:

a molecular sieve permeable only by the gas.

9. The gas storage capsule as in claim 7, wherein the sealed channel contains a rupture membrane.

10. The gas storage capsule as in claim 8, wherein the sealed channel contains a rupture membrane.

11. A method of filling a capsule with a gas comprising:

placing a sorbent material into the capsule comprising a gas impermeable body, the gas impermeable body having a sorbent-free portion and being capable of releasing the gas and retaining the sorbent material inside the gas impermeable body;

placing a predetermined amount of a solidified gas into the sorbent-free portion, wherein the solidified gas becomes a propellant gas when released by the capsule; and sorbing the gas inside the gas impermeable body by the sorbent material.

12. The method of claim 11, wherein placing the predetermined amount of the solidified gas into the sorbent-free portion is done before placing the sorbent material into the capsule.

13. The method of claim 12, wherein the gas impermeable body is cylindrical and is comprised of at least two portions.

14. The method of claim 11, wherein the gas impermeable body is cylindrical and is comprised of at least two portions.

* * * * *